United States Patent [19]

Suzuki et al.

[11] 4,075,587

[45] Feb. 21, 1978

[54] MULTICONTACT SEALED ELECTROMAGNETIC COORDINATE SELECTION DEVICE

[75] Inventors: Hideo Suzuki; Ginya Ishiguro; Sadayuki Mitsuhashi; Kazutoshi Wakamatsu, all of Tokyo, Japan

[73] Assignees: Nippon Telegraph and Telephone Public Corporation; Nippon Electric Co., Ltd., both of Tokyo, Japan

[21] Appl. No.: 731,315

[22] Filed: Oct. 12, 1976

[30] Foreign Application Priority Data

| | | |
|---|---|---|
| Oct. 23, 1975 | Japan | 50-127827 |
| Nov. 12, 1975 | Japan | 50-135841 |
| Nov. 12, 1975 | Japan | 50-135842 |

[51] Int. Cl.[2] ..... H01H 67/14

[52] U.S. Cl. ..... 335/112; 200/175

[58] Field of Search ..... 335/111, 112; 200/175

[56] References Cited

U.S. PATENT DOCUMENTS

| | | | |
|---|---|---|---|
| 3,942,142 | 3/1976 | Kato et al. | 335/112 |
| 3,953,813 | 4/1976 | Yano et al. | 335/112 |

*Primary Examiner*—George Harris

*Attorney, Agent, or Firm*—Flynn & Frishauf

[57] ABSTRACT

A multicontact sealed electromagnetic coordinate selection device comprises a movable contact type spring supported at both ends by supporters at a prescribed interval from a metal plate and electrically insulated from said metal plate, the movable contact type spring elastically supporting a plurality of movable contacts facing the corresponding stationary contacts formed on the upper ends of stationary contact terminals which penetrate said metal plate. The lower ends of said stationary contact terminals are supported by a magnetic metal member.

19 Claims, 25 Drawing Figures

MULTICONTACT SEALED ELECTROMAGNETIC COORDINATE SELECTION DEVICE

BACKGROUND OF THE INVENTION

This invention relates to an electromagnetic coordinate selection device, and more particularly to a multicontact sealed electromagnetic coordinate selection device used in, for example, a communication network of a telephone exchange.

The above-mentioned type of coordinate selection device known to data comprises reed switches or mercury switches provided at the crosspoints of a circuit network like the Ferreed switching system developed by the Bell Research Laboratory of the United States of America. This prior art sealed contact type switching system comprising a plurality of independent unit contacts has the drawbacks that wide variations occur between the operating properties of the respective unit switches, the specific arrangement of said switching system is unadapted for integration, and limitation is imposed on the miniaturization of said switching system, resulting in high manufacturing cost. Therefore, there has been developed, as set forth in the U.S. Pat. No. 3,150,244 a multicontact sealed switching system which is intended for integration of the parts. The switching system of said United States patent is integrated by application of a common plate. However, this switching system has the shortcomings that since contact springs are welded to the inner wall of a container at the corresponding contact portions, assembly work consumes a great deal of time, thermal deformation of the container resulting from said welding gives rise to variations in the contact spaces (namely, an interval between the respective stationary contacts and movable contacts), making it necessary to adjust said contact spaces for each contact portion, signal lines are jointly connected by the container, failing to provide a multicontact sealed electromagnetic coordinate selection device of 2-or-4-line system, rendering the switching system of said United States Patent unadapted to be used as an electromagnetic coordinate selection device for the communication network of a general telephone exchange, and joint connection of a plurality of signal lines by a sealed container gives rise to noticeable isolation loss of high frequency signals due to leakage.

It is accordingly the object of this invention to provide a compact multicontact sealed electromagnetic coordinate selection device which is formed of a smaller number of parts than in the past, enable the crosspoints of a circuit network to be operated uniformly without the necessity of adjusting contact spaces, minimizes isolation loss of high frequency signals and is prominently adapted for general purpose application.

SUMMARY OF THE INVENTION

According to an aspect of this invention, there is provided a multicontact sealed electromagnetic coordinate selection device, which comprises a metal plate having a plurality of holes therein arranged in at least one line; a plurality of stationary contact terminal means each formed of an end portion penetrating the corresponding hole in said metal plate, a stationary contact provided on the end face of the end portion and a core; an insulator for supporting the stationary contact terminal means on the metal plate and electrically insulated from the metal plate; magnetic flux path-forming means provided with a movable contact type spring having movable contacts spaced from the corresponding stationary contacts at a prescribed interval, said spring being provided with an arm for elastically supporting the movable contacts to move them toward the corresponding stationary contacts; supporting means for holding the spring in parallel relationship with the metal plate and electrically insulated therefrom; a sealed container for receiving the magnetic flux path-forming means and stationary contacts in air-tightness; closed magnetic flux path-forming means for providing closed magnetic flux paths in cooperation with the cores and magnetic flux path-forming means; and windings for exciting a magnetic flux in the selected one of said closed magnetic flux paths.

BRIEF DESCRIPTION OF THE DRAWINGS

This invention can be more fully understood from the following detailed description when taken in conjunction with the accompanying drawings, in which:

FIGS. 1 to 4 jointly show a switching mechanism of a multicontact sealed electromagnetic coordinate selection device according to an embodiment of this invention wherein FIG. 1 is a side elevation, exploded in part, of said switching system, FIG. 2 is a cross sectional view on line 2—2 of FIG. 1, FIG. 3 is a cross sectional view on line 3—3, and FIG. 4 is an oblique view of a movable contact type spring;

FIGS. 6 to 8 jointly indicate an electromagnetic coordinate selection device provided with said switching mechanism wherein FIG. 6 is a side elevation, exploded in part, of said device, FIG. 7 is a front view thereof exploded in part, and FIG. 8 is a perspective view of a dismembered portion of said device;

FIGS. 12 and 13 set forth an electromagnetic coordinate selection device according to another embodiment of this invention wherein FIG. 12 is a side elevation, exploded in part, of said device, and FIG. 13 is a front view thereof exploded in part;

FIGS. 16 to 19 jointly show a switching mechanism of an electromagnetic coordinate selection device according to a further embodiment of this invention wherein FIG. 16 is a side elevation, exploded in part, of said switching mechanism, FIG. 17 is a cross sectional view on line 17—17 of FIG. 16, FIG. 18 is a cross sectional view on line 18—18 of FIG. 16, and FIG. 19 is a perspective view of a spring included in the switching system of FIG. 16;

FIGS. 20 and 21 jointly show an electromagnetic coordinate selection device provided with the switching mechanism of FIG. 16 wherein FIG. 20 is a side elevation, exploded in part, of said device, and FIG. 21 is a front view thereof exploded in part;

FIGS. 23 and 24 jointly illustrate another modification of the switching mechanism of FIG. 16 wherein FIG. 23 is a side elevation, exploded in part, of said switching mechanism, and FIG. 24 is a perspective view of a common signal plate included therein.

DETAILED DESCRIPTION

Figure 1:
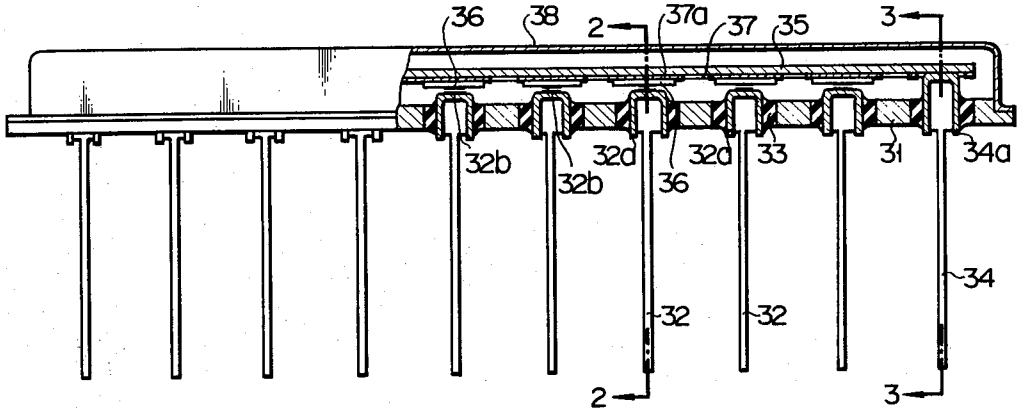
Figure 3:
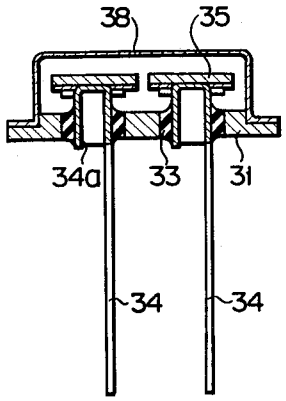
Figure 2:
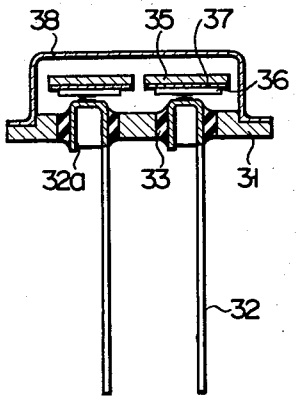

There will now be described by reference to the appended drawings the preferred embodiments of this invention. A multicontact sealed switching mechanism shown in FIGS. 1 to 3 is provided with a large number of (16) contacts, that is, eight contacts on both sides of said switching mechanism. A metal plate 31 is perforated with two rows of 10 holes spaced at a prescribed interval with each hole in one row made to face the corresponding one in the other row.

Figure 4:
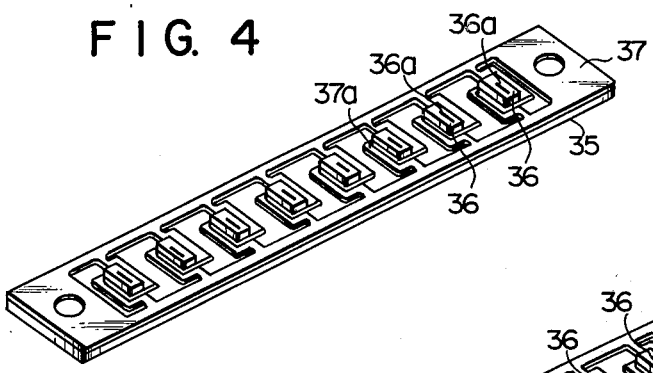

2×8 holes other than those at both ends of each of the above-mentioned two rows receive the heads 32*a* of 2×8 stationary contact terminals 32. The respective heads 32*a* are electrically insulated from the inner walls of the holes by means of an insulator 33 such as glass and also securely supported on the metal plate 31 thereby. Two holes bored at each end of the metal plate 31 securely receive supporters 34 concurrently acting as common signal terminals. The head 32*a* of the stationary contact terminal 32 and the head 34*a* of the supporter 34, both of which are inserted into the corresponding holes so as to protrude above the metal plate 31 are each shaped like an inverted cup. The flat upper end face of the stationary contact terminal 32 is fitted with a stationary contact 32*b*. The head 34*a* of each of two supporters 34 disposed at both ends of the metal plate 31 is made long enough to cause the upper end of said head 34*a* to rise above the upper end face of the head 32*a* of the stationary contact terminal 32. The upper end faces of the heads 34*a* of two supporters 34 provided at each end of the metal plate 31 are disposed on the same horizontal plane. Similarly, the heads 32*a* of the 2×8 stationary contact terminals 32 are arranged on the same horizontal plane. Welded to the upper end face of the supporter 34 is a conductive common signal plate 35 so as to be disposed above the metal plate 31 at a prescribed space and in parallel relationship therewith. The underside of the common signal plate 35 is fitted with a movable contact mechanism (as magnetic flux path-forming means) shown in FIG. 4. The movable contact mechanism is provided with a spring 37 which supports movable pieces 36 whose movable contacts 36*a* (FIG. 4) are disposed right above the corresponding stationary contacts 32*b*.

The spring 37 is formed of a thin metal plate. That portions 37*a* of the spring 37 to which the movable pieces 36 are welded are made to act as a spring by slitting a part of the periphery of said portion 37*a*, thereby supporting the movable pieces 36 for their vertical shift. The lower edge of a metal container 38 is welded to the periphery of the metal plate 31 by means of the projection or seam process so as to seal the metal plate 31. As the result, the movable pieces 36, movable contact type spring 37, common signal plate 35 and the stationary contacts 32*b* provided on the upper end faces of the stationary contact terminals 32 are all sealed in airtightness in an enclosure built of the container 38 and metal plate 31. If said enclosure is filled with inert gas, then the contacts will have a better contact property.

With the above-mentioned switching mechanism, the movable contacts and corresponding stationary contacts can all be set at a prescribed space, simply by fitting the common signal plate 35 previously provided with the movable pieces 36 and movable contact type spring 37 to the supporters 34.

Figure 5:
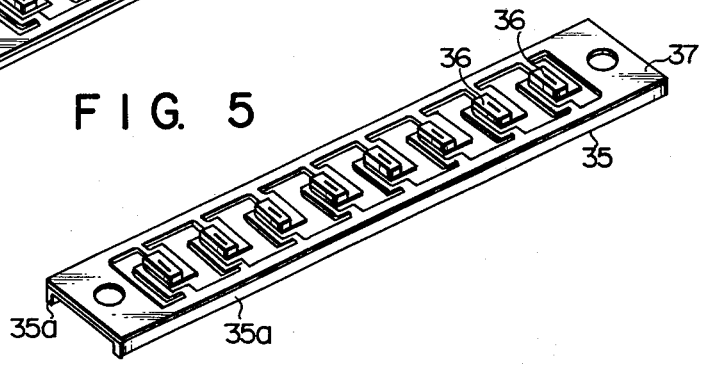
FIG. 5 is a perspective view of a movable contact type spring modified from FIG. 4.

The lateral edge portions of the common signal plate 35 of FIG. 5 are bent vertically for reinforcement before incorporated in the subject switching mechanism. This process enables the common signal plate 35 to have a greater rigidity, minimizes the deformation of said plate 35 when fitted with the movable contact type spring 37 or the supporters 34, and quickly decreases the vibrations of said plate 35 resulting from impingement of the movable pices 36 thereon when they region their original position.

Figure 6:
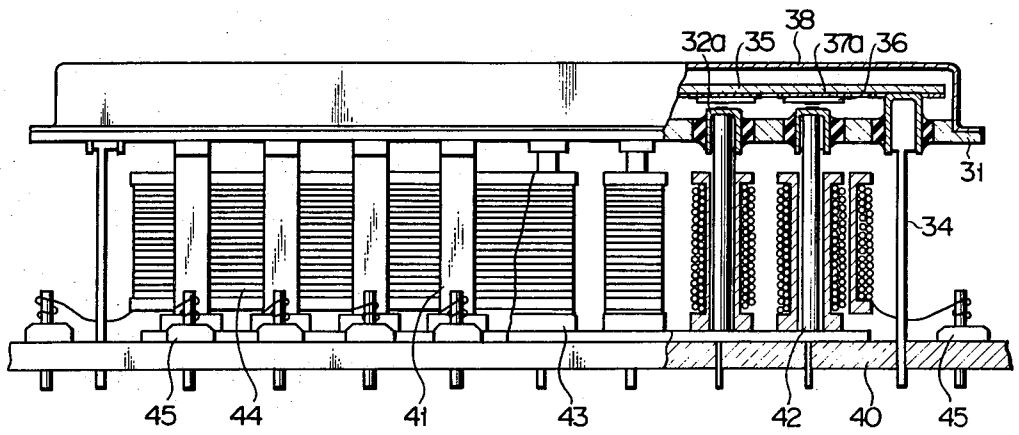
Figure 7:
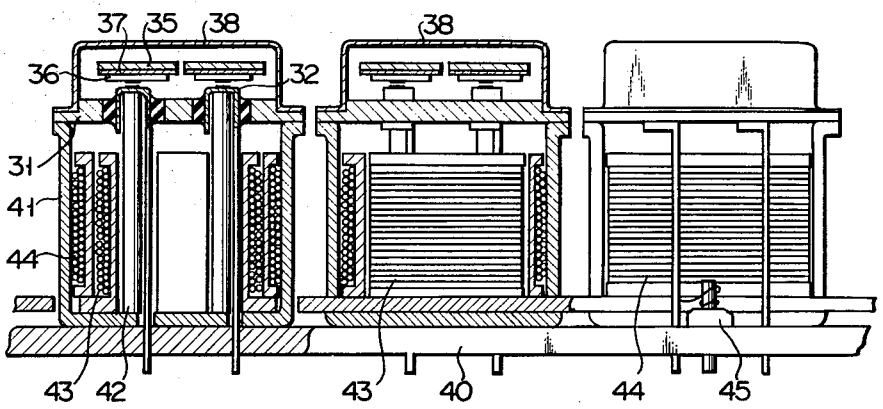
Figure 8:
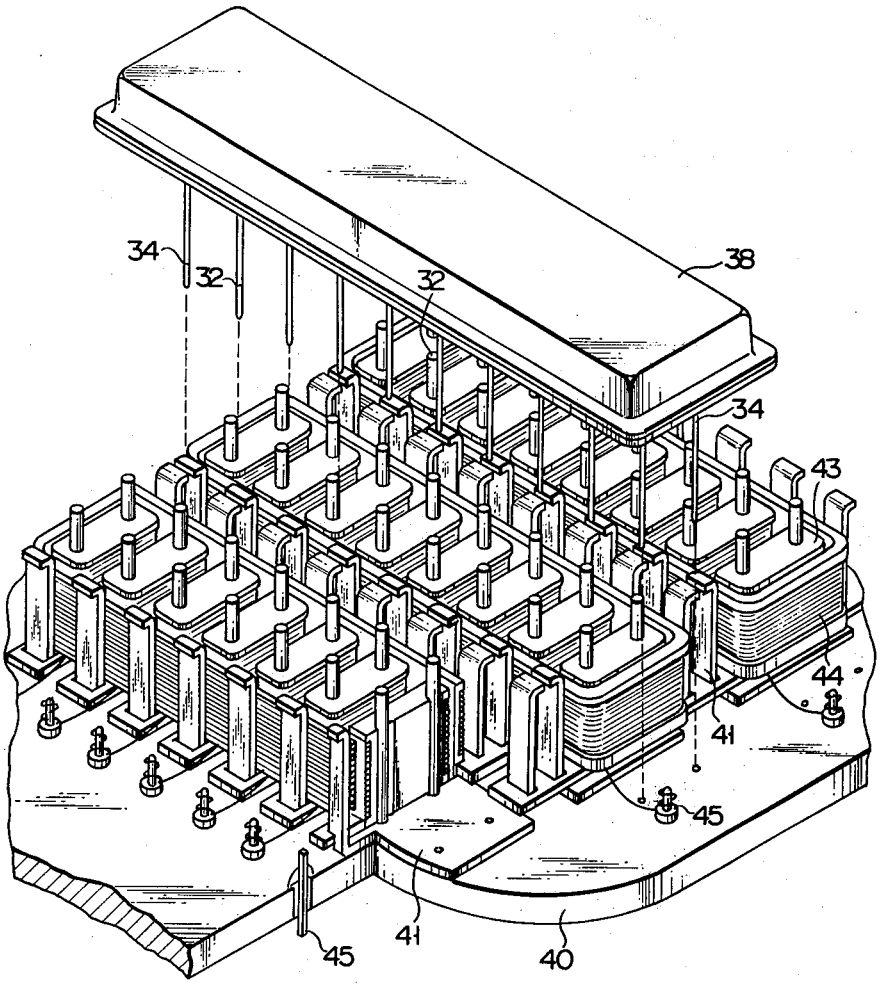

FIGS. 6 to 8 jointly illustrate a multicontact electromagnetic coordinate selection device according to another enbodiment of this invention which is provided with a plurality of the above-mentioned switching mechanism. This embodiment has an electrically insulated substrate 40 on which signal lines and driving lines are printed. Fitted to the surface of the substrate 40 are a plurality of yokes 41 of the known type for forming closed magnetic flux paths. A hole vertically penetrating each yoke 41 receives each of the stationary contact terminals 32 of the switching mechanism and a core 42. That portion of the core 42 which contacts the yoke 41 is coated with electrically insulating material to establish electrical insulation between the yoke 41 and core 42. The stationary contact terminal 32 is inserted into the vertical hole of the yoke to be electrically insulated from the yoke 41. The substrate 40 is bored with holes for securely receiving the lower ends of the stationary contact terminals 32 and supporters 34.

Primary driving winding 43 surrounds each pair of cores 42 arranged in the row direction. Secondly winding 44 surrounds each group of cores 42 arranged in the columnar direction. A leadout terminal 45 of said primary and secondly windings is so provided at the substrate 40 as to penetrate it and soldered to the back side thereof. The electromagnetic coordinate selection device of FIG. 6 containing a plurality of switching mechanism is assembled as illustrated in FIG. 8. Yokes 41 are fixed at prescribed points on the substrate 40, windings 43, 44 are fitted, and leads are attached to the respective leadout terminals 45. Therefore, the cores 42 are securely inserted into the cavities of the winding spools. The multicontact sealed switching mechanism is securely set in place as shown in broken lines by inserting the stationary contact terminals 32 and supporters 34 into the vertical holes bored in the winding spools, yokes 41 and substrate 40 and soldering the stationary contact terminal 32 and supporters 34 to the backside of the substrate 40. Thus, the cores 42, stationary contact terminals 32 and yokes 41 are tightly attached to the substrate 40.

Figure 9:
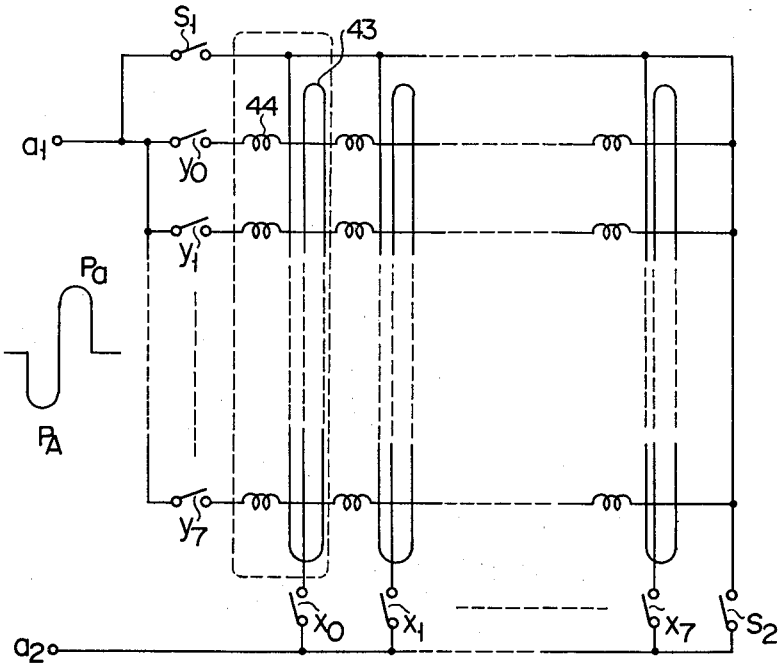
FIGS. 9 and 10 show different arrangements of winding for driving the electromagnetic coordinate selection device of this invention.
Figure 10:
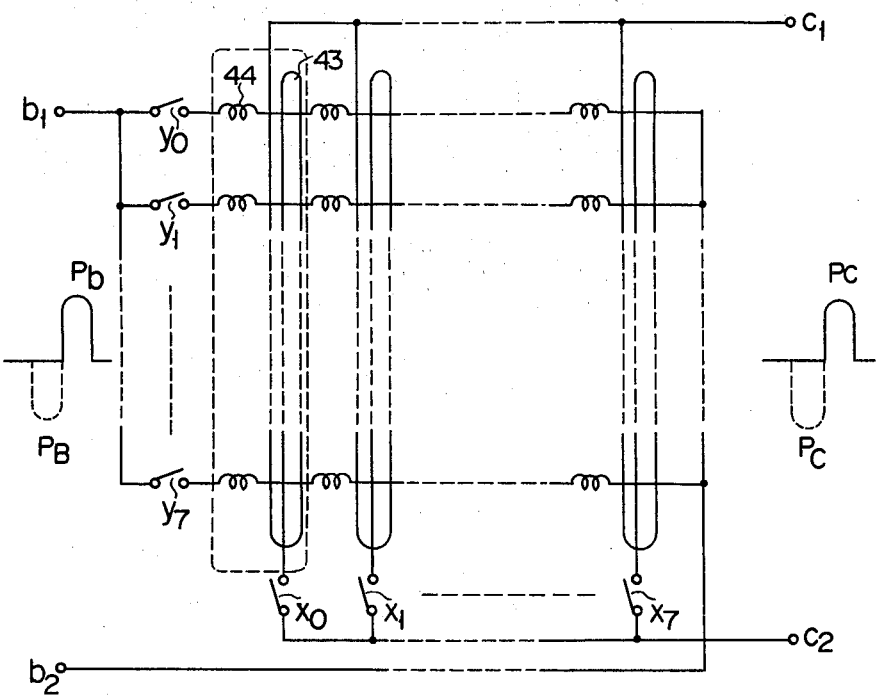

Where, with the above-mentioned switching mechanism, any crosspoint of a circuit network is selectively operated, selection current is introduced into the selected winding through the corresponding conductor printed on the substrate 40 to close the selected crosspoint. FIGS. 9 and 10 illustrate the method by which such windings are connected. The method of FIG. 9 is used where crosspoints arranged in rows and columns are selectively operated by a single pulser, while the method of FIG. 10 is applied where crosspoints arranged in rows and columns are selectively operated by separate pulsers. In FIGS. 9 and 10, characters $x_0$ to $x_7$ are switches for selecting crosspoints arranged in rows; characters $y_0$ to $y_7$ are switches for selecting crosspoints arranged in columns; characters $s_1$, $s_2$ are switches for releasing the selected crosspoint; characters $a_1$, $a_2$, $b_1$, $b_2$, $c_1$, $c_2$ are input terminals of driving pulses; characters $P_A$, $P_B$, $P_C$ are releasing pulses; and characters $P_a$, $P_b$, $P_c$ are operating pulses. A section enclosed in broken lines denote a single multicontact sealed switching mechanism. Where, with the releasing switches $s_1$, $s_2$ of FIG. 9 left upon, given switches *xm, yn* are closed and a releasing pulse $P_A$ and operating pulse $P_a$ are supplied between both input terminals $a_1$, $a_2$, then all the crosspoints of the *xm* row and the *y* columns except for the *yn* column and all the crosspoints of the *yn* column and the *x* rows except for the *xm* row are release, and the crosspoints of only the *xm* row and the *yn* column are selectively closed. Where the switch $s_1$, in closed only upon receipt of a releasing pulse $P_A$, and the same operation as described above is carried out, then all the crosspoints of the *xm* row and the *y* column except for the *yn* column are released, causing the crosspoints of only the *xm* row and the *yn* column are selectively closed. Further where the switch $s_2$, is closed only upon receipt of the releasing pulse $P_A$, then all the crosspoint of the *yn* column and the *x* rows except for the *xm* row are released, causing the crosspoints of only the *xm* row and *yn* column are selectively closed. Therefore, where, upon receipt of the releasing pulse $P_A$, the switch $s_1$ is closed, then the *y* columns are prevented from being released. Where, upon receipt of the releasing pulse $P_A$, the switch $s_2$ is closed, then the *x* rows are prevented from being released. Therefore, depending on the closing or opening of the switches $s_1$, $s_2$, a communication network is so connected as to admit of interruption on row or column, or row and column. Obviously, the switches $s_1$, $s_2$ may be replaced by diodes.

Where, with the circuit arrangement of FIG. 10, the switches *xm, yn* are closed and the releasing pulse $P_B$ and operating pulse $P_b$ are supplied between the input terminals $b_1$, $b_2$ and the releasing pulse $P_C$ and operating pulse $P_c$ are supplied between the input terminals $c_1$, $c_2$ so as to attain coincidence between the polarities of signals thus supplied, then all the crosspoints of the *yn* column and *x* rows except for the *xm* row and those of the *xm* row and *y* columns except for the *yn* column are released, causing only the crosspoints of the *xm* row and *yn* column to be selectively closed. Where the operating pulse $P_b$ alone is supplied between the input terminals $b_1$, $b_2$, and the releasing pulse $P_C$ and operating pulse $P_c$ are supplied between the input terminals $c_1$, $c_2$, then all the crosspoints of the *xm* row and the *y* columns except for the *yn* column are released, causing only the crosspoints of the *xm* row and *yn* column to be selectively closed. Depending on the supply or absence of the releasing pulse $P_B$ or $P_C$, therefore, a communication network can be so connected as to admit of interruption on row or column, or row and column.

Figure 11:
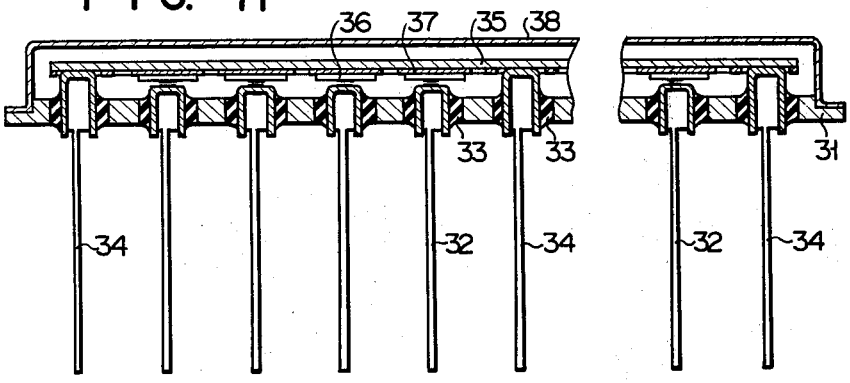
FIG. 11 is a cross sectional view of a switching mechanism modified from that of FIGS. 1 to 4.
Figure 15:
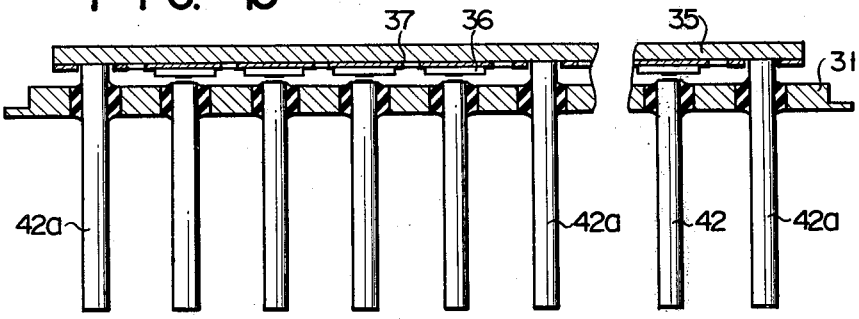
FIG. 15 is a cross sectional view of a switching mechanism modified from that which is included in the device of FIG. 14.

With the aforesaid multicontact sealed switching mechanism of FIG. 1, supporters 34 were provided only at both ends of the metal plate 31. However, the supporters 34 may be additionally placed on both lateral sides of the central portion of the metal plate 31 as shown in FIG. 11. There will now be described by reference to FIG. 11 a switching mechanism modified from that of FIG. 4. The parts of FIG. 11 the same as those of the switching mechanism of FIG. 1 are denoted by the same numeral, the description thereof being omitted.

Of numerous holes bored in the metal plate 31 arranged at a prescribed interval in the directions of rows and columns, those positioned at both ends and center of the metal plate 31 receive the heads of the supporters 34, and the other holes receive the heads of stationary contact terminals 32. The supporters 34 and stationary contact terminals 32 are supported on the metal plate 31 by electrically insulating material 33 in a state electrically insulated from said metal plate 31. The head of the supporter 34 protrudes from the metal plate 31 above the inserted head of the stationary contact terminal 32. The common signal plate 35 is supported on the flat end faces of the heads of all the supporters 34 disposed at both ends and the center of the metal plate 31 so as to be positioned parallel therewith. As the result, where the common signal plate 34 presents warps when welded to the supporters 34 provided at both ends of the metal plate 31, the supporters 34 welded to the central part of the metal plate 31 forcefully correct the warps, enabling the movable contacts and stationary contacts to be spaced from each other at an equal distance.

Figure 12:
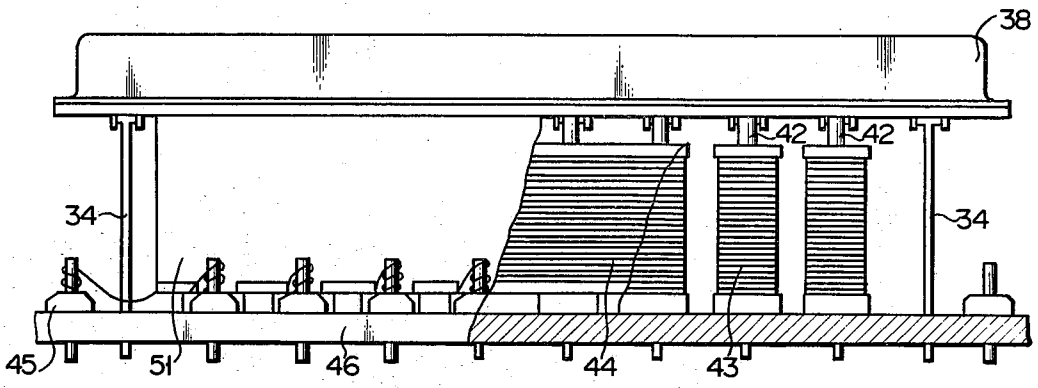
Figure 13:
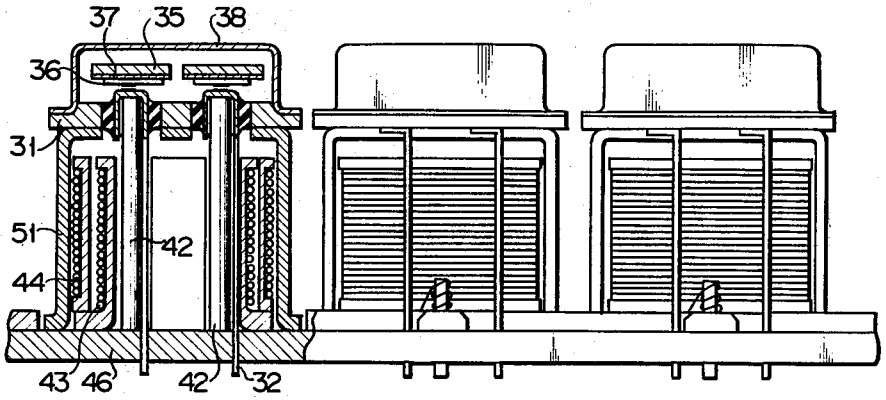
Figure 17:
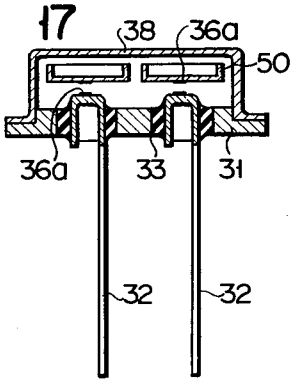
Figure 18:
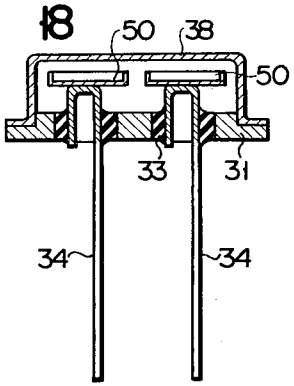

An electromagnetic coordinate selection device of FIGS. 12 and 13 according to another embodiment of this invention comprises a substrate 46 made of magnetic material, and the switching mechanism of FIG. 1. The substrate 46 made of magnetic material is coated with electrically insulating material. Printed on said coating are driving lines and signal lines. Application of the substrate 46 eliminates the necessity of causing a loop to be formed at the lower part of a yoke 51 constituting a closed magnetic flux path as in the yoke 41 of FIG. 7. The upper portions of the lateral sides of said device constituting magnetic flux side paths are bent to rise above the winding 44 and the lower portions of said lateral sides are slightly bent in the horizontal direction to set the device more securely in place. The yoke 51 is bored with holes for loosely receiving the stationary contact terminals 32 to establish electrical insulation between the yoke 51 and stationary contact terminals 32. The lower ends of the stationary contact terminals 32 are soldered to the substrate 46. The upper end of the core 42 is inserted into the head of the stationary contact terminal 32 and the lower end of the core 42 is pressed against the substrate 46.

The electromagnetic coordinate selection device of FIGS. 12 and 13 enables the yoke 51 to be set in place after the windings 43, 44 are provided on the substrate 46. Since the lateral walls of the yoke 51 can be made substantially flat, and a larger contact area is provided between the yoke 51 and substrate 46, a closed magnetic flux path can be more easily formed.

There will now be described by reference to FIG. 14 an electromagnetic coordinate selection device according to still another embodiment of this invention. With this embodiment, stationary contact terminals used with the preceding embodiments are omitted, but stationary contacts are formed on the core itself 42. The upper end face of the core 42 whose lower end is inserted into a hole bored in the substrate 46 made of magnetic material and soldered to the substrate 46 is provided with a stationary contact so as to face the corresponding movable contact 36. The upper portion of the core 42 is inserted into a hole bored in the metal plate 31. Electrically insulating material 33 is filled between the inner wall of the hole and the outer wall of the upper portion of the core 42, thereby keeping the metal plate 31 electrically insulated from the core 42. The supporters of the common signal plate 35 are each formed of a slightly longer core 42*a* than the aforesaid core 42 provided with the stationary contact. The upper end face of said longer core 42*a* is welded to the underside of the end portion of the common signal plate 35 for its support obviously, the supporting core 42*a* may be provided on both lateral sides of the central part of the common signal plate 35 in pursuance to the technical concept described in connection with FIG. 11.

Figure 23:
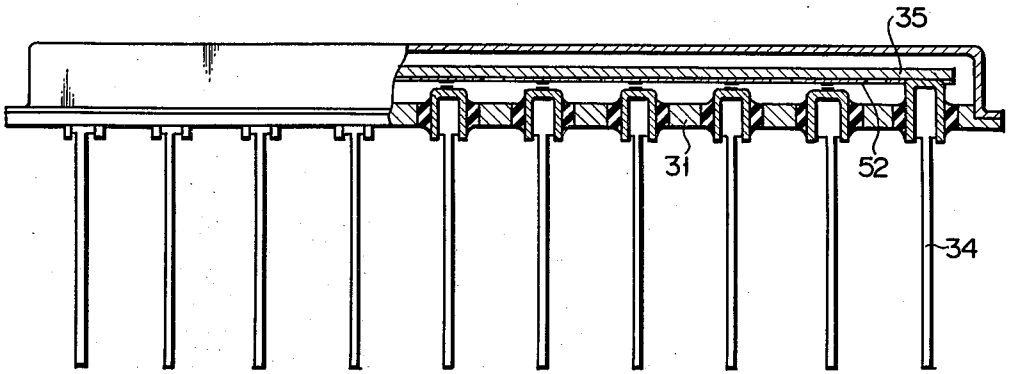

Of the holes bored in the metal plate 31, those on both ends of the metal plate 31 receive the heads of supporters 34 fixed to the metal plate 31 by means of electrically insulating material 33. Both end portions of a common signal plate 35 are welded to the protruding heads of the supporters 34. The common signal plate 35 is provided with a movable contact type spring 52 made of electrically conducting magnetic material. The movable contact type spring 52 has movable contacts so disposed as to face the corresponding stationary contacts. Those portions of the movable contact type spring 52 to which the movable contacts are fitted are elastically supported by an arm portion acting as a spring due to the periphery of said arm portion being slit. The movable contact type spring 52 of the switching mechanism of FIG. 23 is formed of magnetic material, eliminating the necessity of providing movable pieces and in consequence decreasing the number of required parts.

The movable contact means of the switching mechanism of FIGS. 16 to 19 is of a different type from that of the switching mechanism of FIGS. 1 to 4. Of the holes bored by the metal plate 31, those provided at both ends of the metal plate 31 receive the heads 34*a* of the supporters 34 fixed to said metal plate 31 by means of electrically insulating material 33. A movable contact type spring 50 is welded to the end face of each of the protruding heads of the supporter 34. The movable contact type spring 50 is made of electrically conducting magnetic material and concurrently acts as a common signal plate. As apparent from FIG. 19, the spring 50 is constructed by vertically bending the peripheral edges of the spring 50 to be rendered more rigid. The movable contact type spring 50 has movable contacts 36*a* so disposed as to face the corresponding stationary contacts. Those portions of the movable contact type spring 50 to which the movable contacts 36*a* are fitted are elastically supported by an arm portion 50*a* acting as a spring due to the periphery of said arm portion being slit. The lower edge of the container 38 is welded to the periphery of the metal plate 31.

Figure 16:
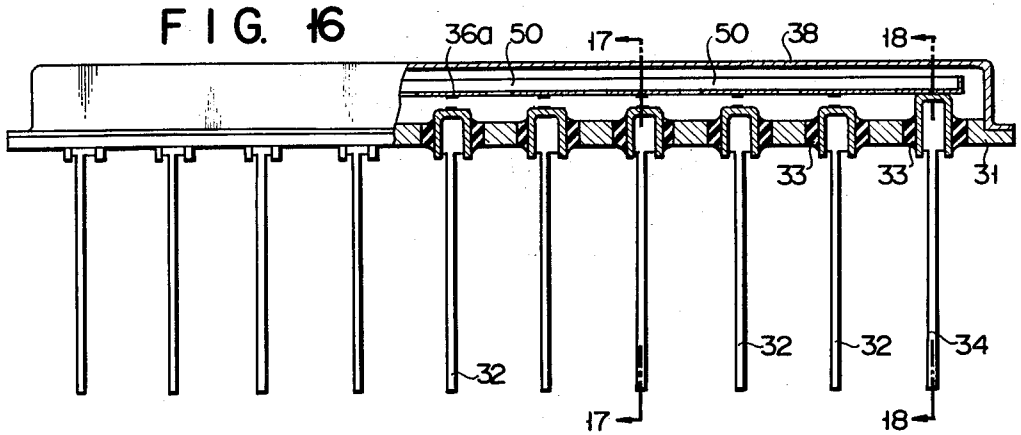

The movable contact type spring 50 of the switching mechanism of FIG. 16 is formed of magnetic material. The peripheral edge of said mechanism is vertically bent to provide reinforcement against warps which might otherwise occur in said movable contact type spring 50, thus eliminating the necessity of providing a common signal plate. The movable contact type spring 50 concurrently acts as a common signal plate, decreasing the number of required parts and simplifying the arrangement of the whole switching mechanism.

Figure 20:
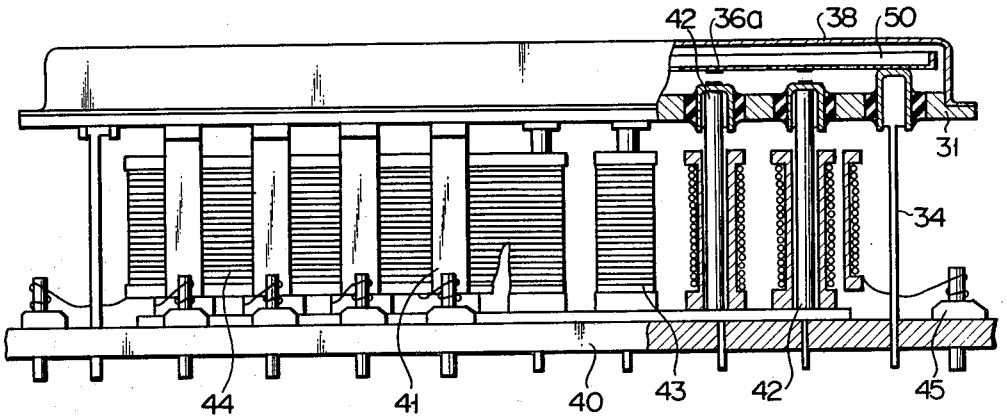
Figure 21:
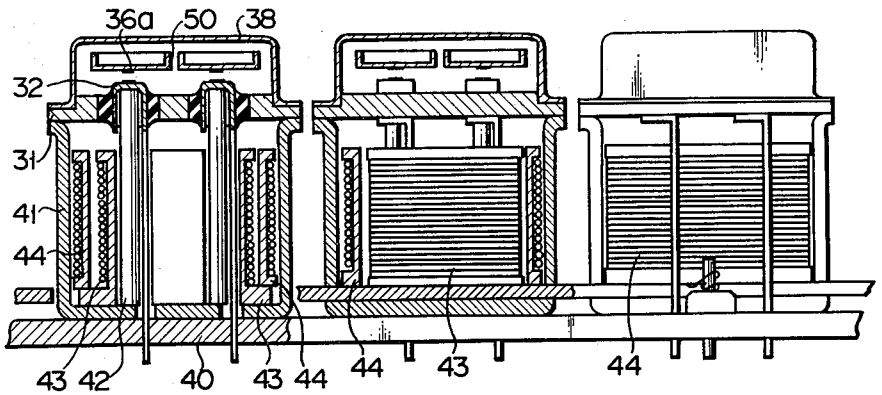

The electromagnetic coordinate selection device of FIGS. 20 and 21 is of the same type as that of FIGS. 6 and 7, excepting that the switching mechanism is formed of that of FIG. 16. The parts of FIGS. 20 and 21 the same as those of FIGS. 6 and 7 are denoted by the same numerals, description thereof being omitted.

Figure 22:
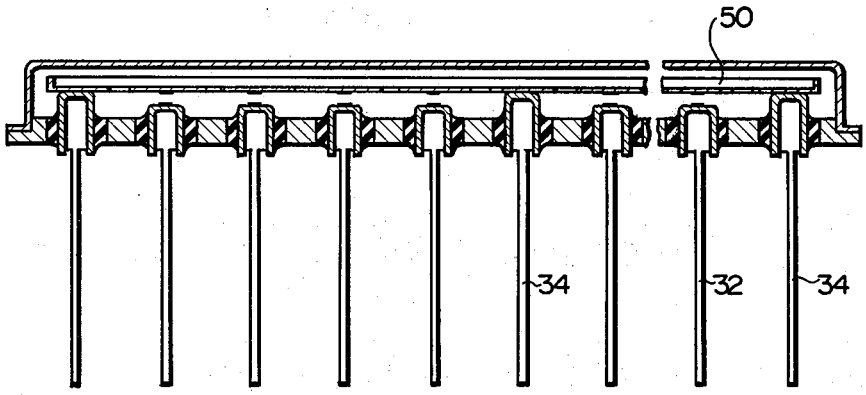
FIG. 22 is a cross sectional view of a switching mechanism modified from that of FIG. 16.

Like the switching mechanism of FIG. 11, the switching mechanism of FIG. 22 has supporters 34 provided on both lateral sides of the proximity of the center of the metal plate to support the common signal plate (or the common signal plate 35 of FIG. 11 and the movable contact type spring 50 of FIG. 16).

Figure 24:
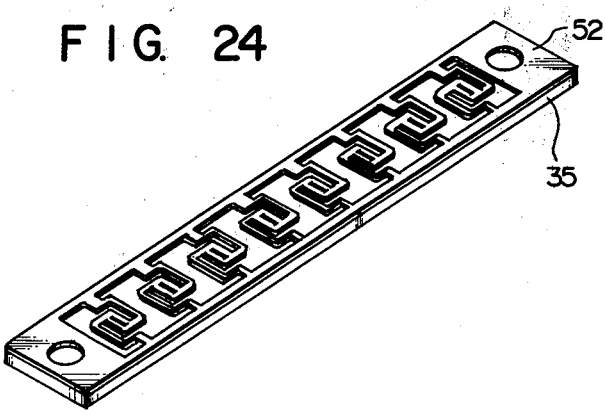

The movable contact means of the switching mechanism of FIGS. 23 and 24 is different type from that of the switching mechanism of FIGS. 1 to 4.

Figure 14:
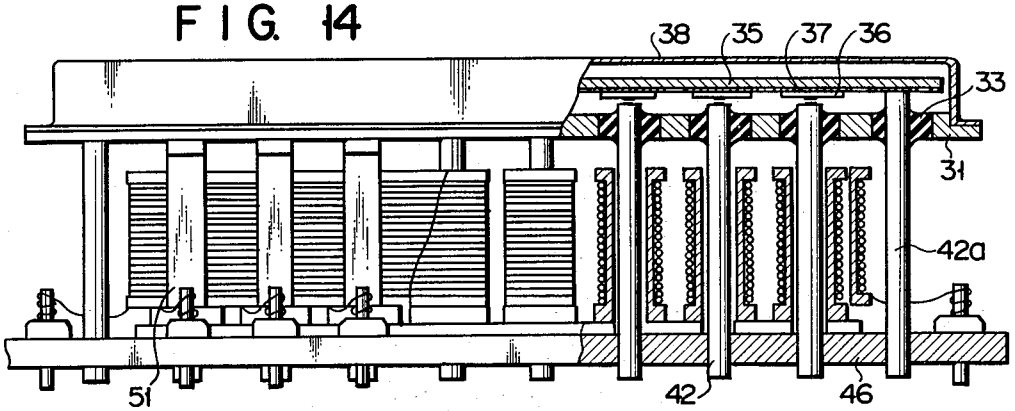
FIG. 14 is a side elevation, exploded in part, of an electromagnetic coordinate selection device according to still another embodiment of this invention.
Figure 19:
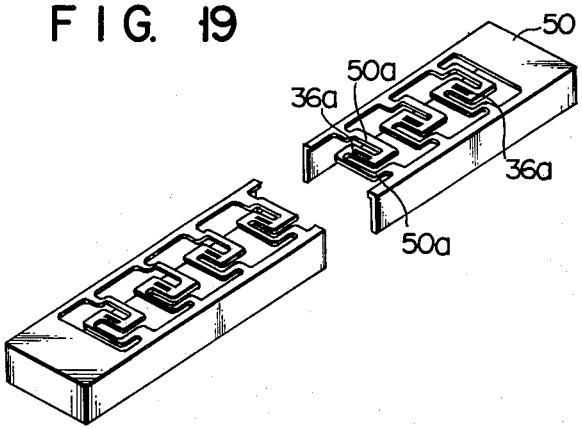
Figure 25:
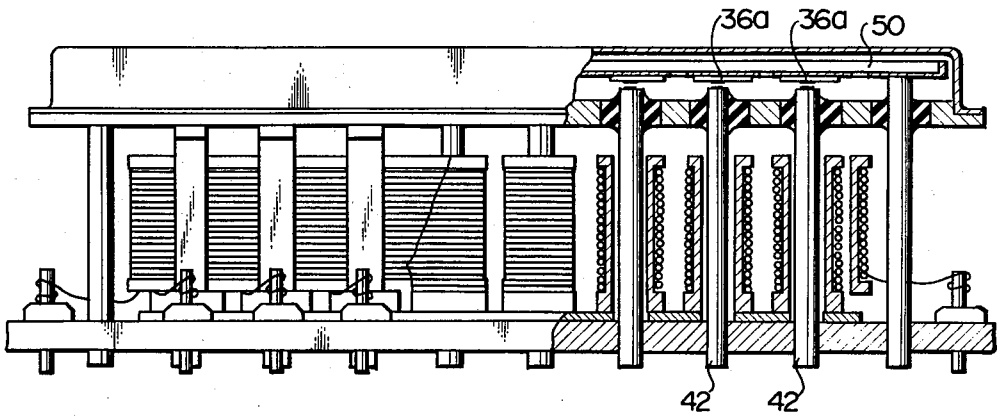
FIG. 25 is a side elevation, exploded in part, of an electromagnetic coordinate selection device according to a still further embodiment of this invention.

FIG. 25 shows a multicontact sealed electromagnetic coordinate selection device according to the other embodiment, representing the case where an assembly of a common signal plate and a movable contact type spring included in the switching mechanism of FIG. 14 is replaced by the movable contact type spring 50 of FIG. 19. In the embodiment of FIG. 25, movable contacts 36*a* mounted on the movable contact type spring 50 face the stationary contacts provided on the upper surface of the cores 42.

What we claim is:

1. A multicontact sealed electromagnetic coordinate selection device comprising a metal plate having holes therein arranged in at least one line; stationary contact terminal means, one end portion of which penetrates the corresponding hole in said metal plate and which includes a stationary contact formed on the end face of said one end portion and cores; electrically insulating material for supporting stationary contact terminal means on the metal plate and electrically insulating said contact terminal means from the metal plate; magnetic flux path-forming means including a movable contact type spring having movable contacts facing the corresponding stationary contacts with a prescribed spacing therebetween, said spring comprising arms for elastically supporting the movable contacts to move them toward the corresponding movable contacts; supporting means for holding the magnetic flux path-forming means in parallel relationship with the metal plate, said magnetic flux path-forming means being electrically insulated from the metal plate; a container for sealing the magnetic flux path-forming means and stationary contacts; closed magnetic flux path-forming means for providing a closed magnetic flux path in cooperation with the core and magnetic flux path-forming means; and windings for selectively exciting a magnetic flux in said closed magnetic flux path.

2. An electromagnetic coordinate selection device according to claim 1, wherein the core of the stationary contact terminal means penetrates the corresponding hole in the metal plate and has the end face of one end portion fitted with the stationary contact.

3. An electromagnetic coordinate selection device according to claim 2, wherein the closed magnetic flux path-forming means comprises a substrate for supporting the other end portion of the core and a yoke mounted on said substrate to form a closed magnetic flux path therewith.

4. An electromagnetic coordinate selection device according to claim 3, wherein the magnetic flux path-forming means comprises a common signal plate which is supported by said supporting means, and said movable contact type spring is made of magnetic material and is fitted to one side of the common signal plate, and provided with said movable contacts.

5. An electromagnetic coordinate selection device according to claim 3, wherein the movable contact type spring of said magnetic flux path-forming means is made of magnetic material, supported by said supporting means, and provided with movable contacts.

6. An electromagnetic coordinate selection device according to claim 2, wherein the closed magnetic flux path-forming means comprises a magnetic substrate supporting the other end of the core and a yoke mounted on said substrate to form a closed magnetic flux path therewith.

7. An electromagnetic coordinate selection device according to claim 6, wherein the closed magnetic flux path-forming means comprises a common signal plate which is supported by said supporting means and to one side of which there is fitted a movable contact type spring made of magnetic material and provided with said movable contacts.

8. An electromagnetic coordinate selection device according to claim 6, wherein the movable contact type spring of the closed magnetic flux path-forming means is made of magnetic material, supported by said supporting means, and provided with said movable contacts.

9. An electromagnetic coordinate selection device according to claim 1, wherein the stationary contact terminal means comprises a stationary contact terminal, which penetrates the corresponding hole in the metal plate and on one end face of which said stationary contact is mounted, and the core.

10. An electromagnetic coordinate selection device according to claim 9, wherein the closed magnetic flux path-forming means comprises a substrate supporting the other end of said stationary contact terminal and a yoke mounted on said substrate to form a closed magnetic flux path therewith.

11. An electromagnetic coordinate selection device according to claim 10, wherein the closed magnetic flux path-forming means comprises a common signal plate which is supported by said supporting means and to one side of which there is fitted a movable contact type spring formed of a magnetic plate and provided with said movable contacts.

12. An electromagnetic coordinate selection device according to claim 10, wherein the spring of the closed magnetic flux path-forming means is made of magnetic material, supported by said supporting means, and provided with said movable contacts.

13. An electromagnetic coordinate selection device according to claim 9, wherein the closed magnetic flux path-forming means comprises a magnetic substrate which abuts against one end of said cores and supports the other end of said stationary contact terminal, and a yoke which is mounted on said substrate to form a closed magnetic flux path therewith.

14. An electromagnetic coordinate selection device according to claim 13, wherein the closed magnetic flux path-forming means comprises a common signal plate which is supported by said supporting means, and said spring is made of magnetic material, mounted on one side of the signal plate material and provided with said movable contacts.

15. The electromagnetic coordinate selection device according to claim 13, wherein, the movable contact type spring of the closed magnetic flux path-forming means is made of magnetic material, supported by said supporting means and provided with said movable contacts.

16. An electromagnetic coordinate selection device according to claim 1, wherein said supporting means have heads penetrating corresponding holes at both ends of the metal plate to hold both ends of said closed magnetic flux path-forming means, thereby spacing said closed magnetic flux path-forming means from said metal plate at a prescribed distance.

17. An electromagnetic coordinate selection device according to claim 16, wherein said supporting means has an intermediate unit penetrating holes on both lateral sides of the central portion of the metal plate, thereby supporting the intermediate section of the closed magnetic flux path-forming means.

18. An electromagnetic coordinate selection device according to claim 1, wherein the movable contact type spring of the closed magnetic path-forming means is formed of a metal plate which comprises an arm portion provided with movable contacts, said arm portion having its periphery slit to act as a spring.

19. An electromagnetic coordinate selection device according to claim 18, wherein the metal plate of said movable contact type spring has its peripheral edge bent for reinforcement.

* * * * *